United States Patent [19]

Tàrasescu et al.

[11] Patent Number: 4,482,376

[45] Date of Patent: Nov. 13, 1984

[54] METHOD OF AND APPARATUS FOR MELTING AND CASTING REACTIVE METALS

[75] Inventors: Mihail Tàrasescu; Margareta Oproiu; Alexandru Asultanei; Grigore Bucur; Nicu Ceausescu; Constantin Popovici; Mihai Balaceanu; Mihai Popescu, all of Bucharest, Romania

[73] Assignee: Institutul De Cercetare Stiintifica, Inginerie Tehnologica Si Proiectare Pentru Sectoare Calde, Bucharest, Romania

[21] Appl. No.: 555,434

[22] PCT Filed: Oct. 9, 1981

[86] PCT No.: PCT/RO81/00006

§ 371 Date: Jul. 9, 1982

§ 102(e) Date: Jul. 9, 1982

[87] PCT Pub. No.: WO82/01677

PCT Pub. Date: May 27, 1982

Related U.S. Application Data

[63] Continuation of Ser. No. 403,508, Jul. 9, 1982, abandoned.

[30] Foreign Application Priority Data

Nov. 14, 1980 [RO] Romania ..... 102590

[51] Int. Cl.[3] ..... C22B 4/00

[52] U.S. Cl. ..... 75/10 R; 75/65 EB; 164/250.1

[58] Field of Search ..... 75/10–12, 75/65 EB; 164/250.1, 505

[56] References Cited

U.S. PATENT DOCUMENTS

| | | | |
|---|---|---|---|
| 3,005,859 | 10/1961 | Candidus | 75/65 EB |
| 3,342,250 | 9/1967 | Treppschuh | 75/49 |
| 3,519,059 | 7/1970 | Voskoboinikov | 75/10 R |
| 3,658,119 | 4/1972 | d'Hunt | 75/49 |
| 3,736,124 | 5/1973 | Paton | 75/10 R |

OTHER PUBLICATIONS

*Revue Roumaine de Physique*, Tome 25, 1980, No. 9, (pp. 1005–1013).

*Vacumm Metallurgy*, Chapter 5, (pp. 592–643).

*Primary Examiner*—Peter D. Rosenberg

*Attorney, Agent, or Firm*—Karl F. Ross; Herbert Dubno

[57] ABSTRACT

Process and installation for melting-pouring strongly reactive and high-melting metals and alloys.

The process and installation according to the invention solves the problem of melting-pouring strongly reactive and high-melting metals and alloys by using a plasma electron source, running at pressures of $10^{-1}$–$10^{-2}$ torr, the distribution of the electron beam and the compensation of the heat losses being obtained through a suitable configuration of the electrodes.

This process and installation can be applied for obtaining castings out of strongly reactive and high-melting metals and alloys, required for aeronautics, nuclear technique and chemical industry.

3 Claims, 1 Drawing Figure

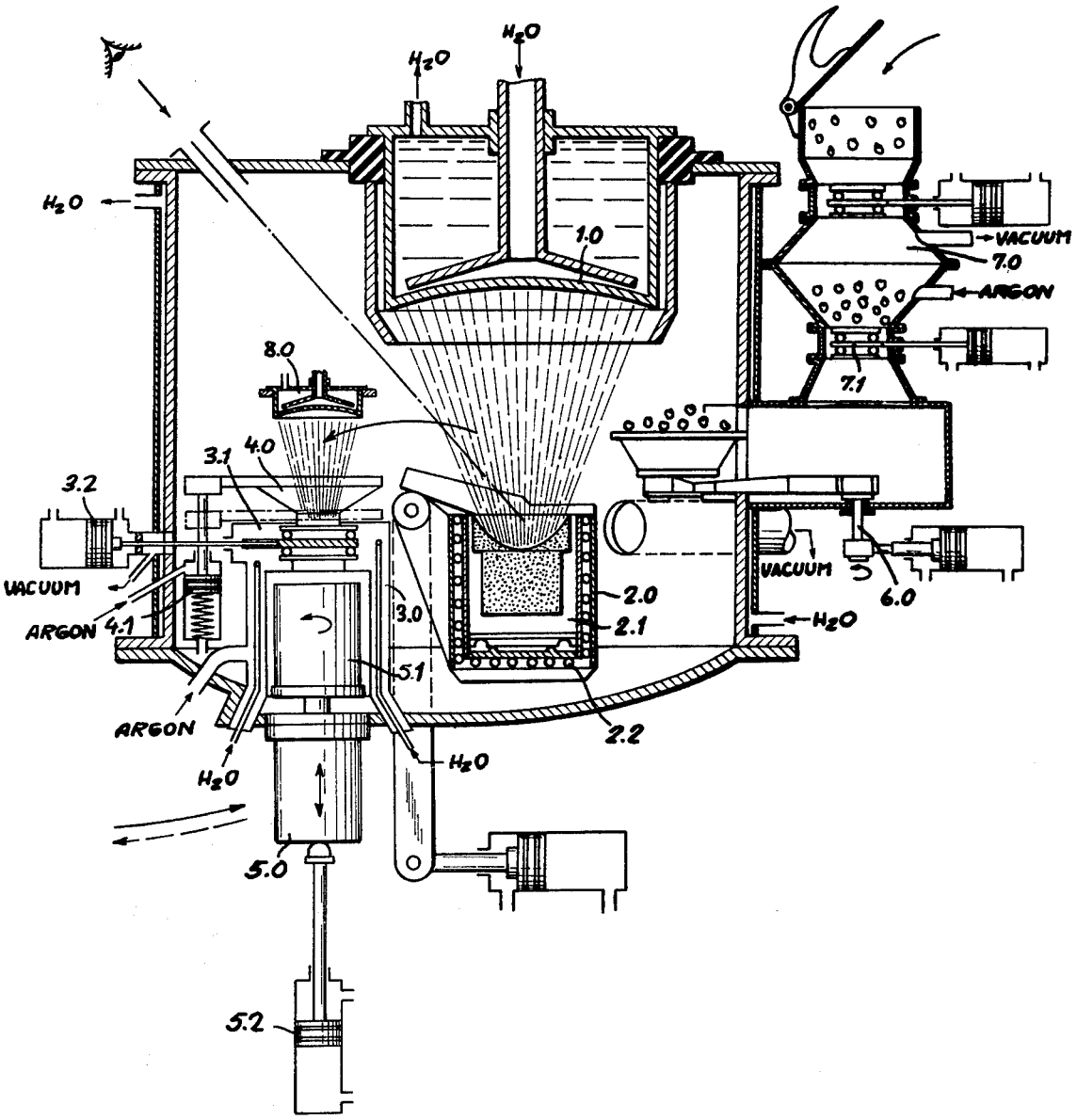
$H_2O$
$H_2O$
$H_2O$
1.0
VACUUM
7.0
ARGON
7.1
8.0
4.0
3.1
3.2
VACUUM
ARGON
4.1
3.0
2.0
2.1
VACUUM
6.0
$H_2O$
5.1
ARGON
$H_2O$
$H_2O$
2.2
5.0
5.2

METHOD OF AND APPARATUS FOR MELTING AND CASTING REACTIVE METALS

This application is a continuation of application Ser. No. 403,508 filed July 9, 1982, now abandoned.

CROSS REFERENCE TO RELATED APPLICATIONS

This is a national phase application corresponding to PCT/RO-81/00006 filed Oct. 9, 1981 and based upon Romanian National application Ser. No. 102,590 filed Nov. 14, 1980.

FIELD OF THE INVENTION

The invention relates to a process and apparatus for melting and pouring highly-reactive and high-melting metals and alloys.

BACKGROUND OF THE INVENTION

Until now in order to melt and pour strongly reactive and high-melting metals and alloys, vacuum consumable-electrode arc furnaces and electron beam furnaces have been used.

Vacuum consumable-electrode arc furnaces have, besides their well-known advantages a series of disadvantages for melting and pouring strongly reactive and high-melting metals and alloys, namely: great difficulty in producing high temperatures, the need to replace consumed electrode stubs with ready-made electrodes, great difficulty in controlling the melting process, and complex vacuum-tight installations.

Electron beam furnaces also have a number of disadvantages: they require separate chambers for producing the electron beam and for the melting and pouring process; they require two complex vacuum installations (capable of sustaining vacuums to $10^{-5}$ torr) corresponding to the two chambers; the electromagnetic focussing of the electron beam is very complicated and considerable losses through evaporation occur because of the high vacuum.

OBJECT OF THE INVENTION

It is an object of this invention to obviate the disadvantages mentioned above and yet provide the very high temperatures required for melting high-melting alloys, a uniformly space distribution of temperature allowing the melting of a large quantity of alloy, and avoidance of substantial evaporation losses due to high working pressure.

SUMMARY OF THE INVENTION

The installation according to this invention removes the disadvantages mentioned above, using a plasma electron source, in that the electron beam and the melting and pouring process are produced at the same place, at pressures of $10^{-2}$ torr, the beam being focussed through a geometry suitable for the cathode, also allowing compensation of the heat losses at crucible edge, and obtaining a low temperature gradient at the molten bath surface, thus facilitating forming of the molten metal.

BRIEF DESCRIPTION OF THE DRAWING

The sole FIGURE of the drawing is a diagrammatic cross section through an apparatus embodying the invention

SPECIFIC DESCRIPTION

The installation for melting and pouring highly reactive and high-melting metals and alloys is shown in the drawing and comprises an air-excluding enclosure adapted to sustain pressures of $10^{-1}$–$10^{-2}$ torr. The enclosure contains a plasma electron source 1.0, a tiltable crucible 2.0 with graphite radial (cylindrical) shield 2.1 and ceramic axial shield 2.2, a bay for pouring molds 3.0 closed with a valve 3.1, a pouring gate 4.0 thereabove a centrifuging device 5.0 which also internally closes the bay 3.0 a device 6.0 for feeding materials and a bay 7.0 with pneumatically driven valves 7.1 for the materials.

The basic sequence involves loading with materials, melting and pouring, preparation and replacement of pouring moulds, one after another, but taking place independently one from the other. Thus the material to be melted and poured, in the form of pieces with maximum sizes of $\phi 50 \times 50$ mm is introduced into the gate of the materials bay 7.0 from which, via the opening of valves and application of pressure it is first lowered into the intermediary chamber of the bay where it can be vacuum washed and then into the rotary gate of the feeder device for 6.0, that introduces the material into the crucible and retracts for the following batches; in continuous working condition all the levels of the bay and the feeder gate 6.0 are filled with materials that are thus kept in vacuum washing conditions.

The melting process according to a suitable technological diagram starts with drive of plasma electron source.

After bringing the material to the pouring temperature, the pouring mold 52 separately prepared for pouring and mounted on the platform of the centrifuging device 5.0 is lifted by means of the pneumatic motor 5.3 into the bay 3.0 which is evacuated; the pneumatic motor 3.2 moves the door of the valve 3.1 and the gate 4.0 driven by motor 4.1 lowers to the pouring mold 5.2. The sequence concludes with the pouring.

Pouring occurs with driving the centrifuging device 5.0 electrically actuated, at 700 rot/min, after which the electron source 1.0 is stopped, the crucible is tilted back and brought into the position for receiving the materials and a new cycle starts.

In order to prevent the rapid decrease of the molten metal temperature during pouring, another plasma electron source 8.0 of suitable configuration and power less than, the main source, can be mounted above the pouring space.

Replacement of pouring molds starts with stopping of centrifuging device and continues with lifting of the gate 4.0 actuated but motor 4.1, closing of valve door 3.1 equalization of bay pressure 3.0 with environment pressure through feeding the bay with argon, lowering of the centrifuging device 5.0 together with the mold 5.2 and dismounting of the poured mould from the plateform, thus preparing the devices for a new pouring mold.

The process according to the invention has the following advantages:

- it enables the production of high temperatures, required for melting high melting metals and alloys;
- it provides a volume melting, avoiding overheating of surface layers;
- it operates at a working pressure of $10^{-1}$–$10^{-2}$ torr, preventing considerable evaporation of alloying elements;

The installation according to the invention has the following advantages:

it does not require separate enclosures for producing the electron beam and for the melting-pouring process, it does not require complex vacuum equipment;

it does not require electromagnetic focussing and it permits use of a temperature gradient as low as possible inside the molten bath.

We claim:

1. A method of melting and pouring a highly reactive high-melting metallic material which comprises the steps of:

(a) providing a tiltable crucible in an evacuatable enclosure;

(b) evacuating said enclosure to a pressure of $10^{-1}$ to $10^{-2}$ torr;

(c) introducing said material into said enclosure and depositing same in said crucible;

(d) directing a first electron beam source from a high voltage glow discharge, focused upon the material in said crucible by the geometry and relative disposal of the cathode, thereby melting said material;

(e) introducing a mold through a vacuum lock into said enclosure alongside said crucible;

(f) preheating said mold by directing another glow discharge electron beam thereon in said enclosure;

(g) tilting said crucible to pour the molten material from said crucible into the pre-heating said mold; and (h) removing said mold after said molten material has been poured into it through said lock by initially enclosing the mold containing said material in said lock, equalizing said lock to atmospheric pressure with inert gas and withdrawing the mold containing said material from said lock.

2. An apparatus for the melting and pouring of highly reactive high-melting metal material, comprising:

(a) an evacuatable enclosure;

(b) means connected to said enclosure to generate a vacuum of $10^{-1}$–$10^{-2}$ torr thereto;

(c) a tiltable crucible open upwardly in said enclosure;

(d) means for introducing said material into said enclosure and for charging said crucible with said material;

(e) a first glow discharge electron beam source the cathode of which being so shaped that its geometry and disposal focuses the electron beam on the material in the said crucible for melting said material therein;

(f) means for introducing said mold lock into said enclosure;

(g) a second glow discharge electron beam source in said enclosure, which preheats the said mold to pour the molten metal from the said crucible; and (h) means for retracting said mold into said lock for equalizing the pressure in said lock with external pressure by introducing an inert gas into said lock and for thin withdrawing the material-filled mold from said lock.

3. The apparatus defined in claim 2 wherein said means for introducing said material into said enclosure includes a pressure lock and a receptacle for said material exposing it to the pressure in said enclosure before it is charged into said crucible.

* * * * *